US006007179A

United States Patent [19]

Ohtani et al.

[11] Patent Number: 6,007,179

[45] Date of Patent: Dec. 28, 1999

[54] INK-JET HEAD BACK-UP DEVICE AND INK-JET PRINTER

[75] Inventors: Fumito Ohtani; Yukio Sato; Yuichi Sato; Yoshihiro Watanabe, all of Kawasaki, Japan

[73] Assignee: Fujitsu Limited, Kawasaka, Japan

[21] Appl. No.: 08/923,435

[22] Filed: Sep. 4, 1997

[30] Foreign Application Priority Data

Mar. 19, 1997 [JP] Japan ..... 9-066917

[51] Int. Cl.[6] ..... B41J 2/165

[52] U.S. Cl. ..... 347/30

[58] Field of Search ..... 347/29, 30, 31

[56] References Cited

U.S. PATENT DOCUMENTS

| | | | |
|---|---|---|---|
| 5,648,803 | 7/1997 | Koyama et al. | 347/30 |
| 5,883,645 | 3/1999 | Ikado et al. | 347/30 |
| 5,917,515 | 6/1999 | Nonoyama et al. | 347/30 |

FOREIGN PATENT DOCUMENTS

| | | | |
|---|---|---|---|
| 60-104336 | 6/1985 | Japan | 347/30 |
| 5-169680 | 7/1993 | Japan . | |
| 8-169123 | 7/1996 | Japan . | |

*Primary Examiner*—Fred L. Braun

*Attorney, Agent, or Firm*—Armstrong, Westerman, Hattori, McLeland & Naughton

[57] ABSTRACT

A pump absorbs ink from nozzles of an ink-jet head by increasing an internal space of the pump and discharges the ink by decreasing the internal space. A valve has an absorbing path formed therein and a discharging groove formed thereon, and passes through a wall of the pump. A communicating unit communicates with a first end of the absorbing path of the valve and causes the nozzles of the ink-jet head to communicate with the internal space of the pump through the absorbing path. When the pump absorbs ink from the nozzles of the ink-jet head, the valve moves through the wall of the pump so that a second end of the absorbing path is exposed to the internal space of the pump, and the pump increases the internal space. When the pump discharges ink, the valve moves through the wall of the pump so that the second end of the absorbing path is opened externally and the discharging groove is aligned with the wall of the pump, and the pump decreases the internal space.

7 Claims, 8 Drawing Sheets

19
33
31
32
35
34
12a
12
18
13
21
37
38
41
40
33b
33c
33a
P
31a
36
54

INK-JET HEAD BACK-UP DEVICE AND INK-JET PRINTER

BACKGROUND OF THE INVENTION

1. Field of the Invention

The present invention relates to an ink-jet head back-up device and an ink-jet printer.

In an ink-jet printer, ink is sprayed from thin nozzles of an ink-jet head and thereby characters and so forth are printed on a recording medium such as a sheet of paper. In this arrangement, the following problems occur. Ink in the nozzles can become dry and have an increased viscosity. Paper dust can be adhered onto and cover the nozzles because the nozzles are wet due to the ink. Due to vibration, bubbles enter the ink-jet head via the nozzles. Due to these problems, some or all the nozzles clog and ink spray failure occurs. Further, the pressure by which ink is sprayed is absorbed by the bubbles and insufficient spraying is performed. Thus, printing quality is substantially degraded. Further, in an operation where the ink cartridge is replaced with a new old one, air enters the nozzle. When the air entered the nozzles, ink jet failure occurs. In order for the nozzle to provide stable ink jet printing, the ink-jet printer include an ink-jet head back-up device.

The ink-jet head back-up device absorbs forcibly ink from the nozzles. Thereby, high-viscosity ink, bubbles, paper dust and so forth are removed from the ink-jet head. Thus, the ink-jet head back-up device is a sort of head projection mechanism which performs an unclogging operation on a nozzle (hereinafter, simply referred to as a 'purge'). This purge is performed after ink cartridge replacement is performed. In other cases, the purge is performed if necessary or periodically. For example, the purge is during an initial operation immediately after the ink-jet printer power-on operation or when an operator gives an instruction.

2. Description of the Related Art

An ink-jet head back-up device in the related art includes a pump which is connected with a tube from a nozzle cap which covers the nozzles of an ink-jet head, a valve and so forth. In order to miniaturize the ink-jet head back-up device, the valve is included in the pump. The valve is operated by the pressure in the pump or the operation of the pump. Thus, the valve is indirectly operated.

The purge includes, generally speaking, a main purge and an emptying purge. In the main purge, in a condition where the nozzle cap covers the nozzles of the ink-jet head, the pump and valve operate with a predetermined timing. Thereby, first, absorption is performed and ink and bubbles in the nozzles of the ink-jet head are absorbed into the pump. Then, the ink and bubbles are discharged from the pump. In the emptying purge, in a condition where the nozzle cap is removed from the ink-jet head, the above-mentioned operations are performed. Thereby, ink adhered in the nozzle cap and the tube is removed.

As mentioned above, the valve is operated by the pressure in the pump or the operation of the pump. Thus, the valve is indirectly operated. Accordingly, valve closing timing is slightly delayed. Thereby, although instantaneously, ink flows in the reverse direction to the nozzle cap and the purge cannot be properly performed. Thus, the ink-jet head back-up device in the related art has a reliability problem.

SUMMARY OF THE INVENTION

An object of the present invention is to provide an ink-jet head back-up device and an ink-jet printer in which the above-mentioned problems have been solved.

An ink-jet head back-up device according to the present invention absorbs ink or bubbles from nozzles of an ink-jet head which performs printing by spraying ink. The device comprises:

a nozzle cap which covers the nozzles of the ink-jet head;

a pump having an internal space, the volume of which increases and decreases;

a rod shaped valve which is connected with the nozzle cap through a tube, is provided so as to be able to enter and exit from the internal space of the pump, and, depending on its position, is in a first state in which the nozzle cap communicates with the internal space of the pump, is in a second state in which the nozzle cap does not communicate with the internal space of the pump, and is in a third state in which the internal space of the pump communicates with an external space;

pump driving means for driving the pump;

rod valve driving means for moving the rod valve in its axis direction; and control means for controlling the pump driving means and the rod valve driving means so that, after the volume of the internal space of the pump is caused to increase and the rod valve is caused to be in the first state so that ink is absorbed from the nozzles of the ink-jet head into the internal space of the pump, the rod valve is caused to be in the second state, then the volume of the internal space of the pump is caused to decrease and the rod valve is caused to be in the third state.

In this arrangement, after the volume of the internal space of the pump is caused to increase and the rod valve is caused to be in the first state so that ink is absorbed from the nozzles of the ink-jet head into the internal space of the pump, the rod valve is caused to be in the second state, then the volume of the internal space of the pump is caused to decrease and the rod valve is caused to be in the third state. Accordingly, the ink which was absorbed into the pump never flows backward to the nozzle cap. Thus, reliability can be improved.

In the ink-jet head back-up device, it may be that the rod valve is arranged so that its axis is horizontal, and a groove for forming the third state is provided at a lower portion of the rod valve.

Thereby, it is possible to form a discharge path at a low position. Thereby, it is possible that a large amount of ink can be discharged from the pump.

In the ink-jet head back-up device, the pump driving means, the rod valve driving means and the control means may comprise:

a cam member which has a pump driving cam having a predetermined shape and a rod valve driving cam having a predetermined shape; and a motor which rotates the cam member.

Thereby, in comparison to a case where a cam member and a motor is provided for each of the pump driving means and the rod valve driving means, the device can be miniaturized and stable operations can be achieved.

In the ink-jet head back-up device, the pump driving cam and the rod valve driving cam may be formed so that the rod valve driving cam does not move the rod valve when the pump driving cam drives the pump, and the pump driving cam does not drive the pump when the rod valve driving cam moves the rod valve.

Thereby, the load borne by the motor can be dispersed and a low-torque motor can be used. Further, it is possible to achieve smooth operations of the ink-jet head back-up device In the ink-jet head back-up device:

the cam member further has a carriage locking rod driving cam; and a carriage locking rod is moved by the carriage locking rod driving cam and thereby the ink-jet head is locked when ink is absorbed from the nozzles of the ink-jet head into the internal space of the pump.

Due to the forgoing construction, accidental ink discharge can be positively prevented. For example, if the ink-jet head is accidentally moved when ink is absorbed or otherwise removed from the ink-jet head, and if the nozzle cap has been removed from the ink-jet head, ink can be uncontrollably discharged outside the back-up device. This results in surrounding portions being soiled or contaminated by the accidentally discharged ink.

An ink-jet printer according to the present invention comprises:

an ink-jet head which sprays ink so as to perform printing; and an ink-jet head back-up device for absorbing ink or bubbles from nozzles of the ink-jet head, the ink-jet head back-up device comprising:

a nozzle cap which covers the nozzles of the ink-jet head;

a pump having an internal space, the volume of which increases and decreases;

a rod valve having a rod shape connected with the nozzle cap through a tube so as to enter and exit from the internal space of the pump, and, depending on valve position, assumes a first state in which the nozzle cap communicates with the internal space of the pump, a second state in which the nozzle cap does not communicate with the internal space of the pump, and a third state in which the internal space of the pump communicates with an external space;

pump driving means for driving the pump;

rod valve driving means for moving the rod valve in an axial direction; and control means for controlling the pump driving means and the rod valve driving means so that, after the volume of the internal space of the pump is increased and the rod valve is in the first state so that ink is absorbed from the nozzles of the ink-jet head into the internal space of the pump, the rod valve is moved to the second state so that the volume of the internal space of the pump is decreased and the rod valve is moved to the third state.

In this arrangement, it is possible to provide the ink-jet printer with a highly reliable purge operation, as compared to the prior art.

Other objects and further features of the present invention will become more apparent from the following detailed description when read in conjunction with the accompanying drawings.

DETAILED DESCRIPTION OF THE PREFERRED EMBODIMENT

Figure 1:
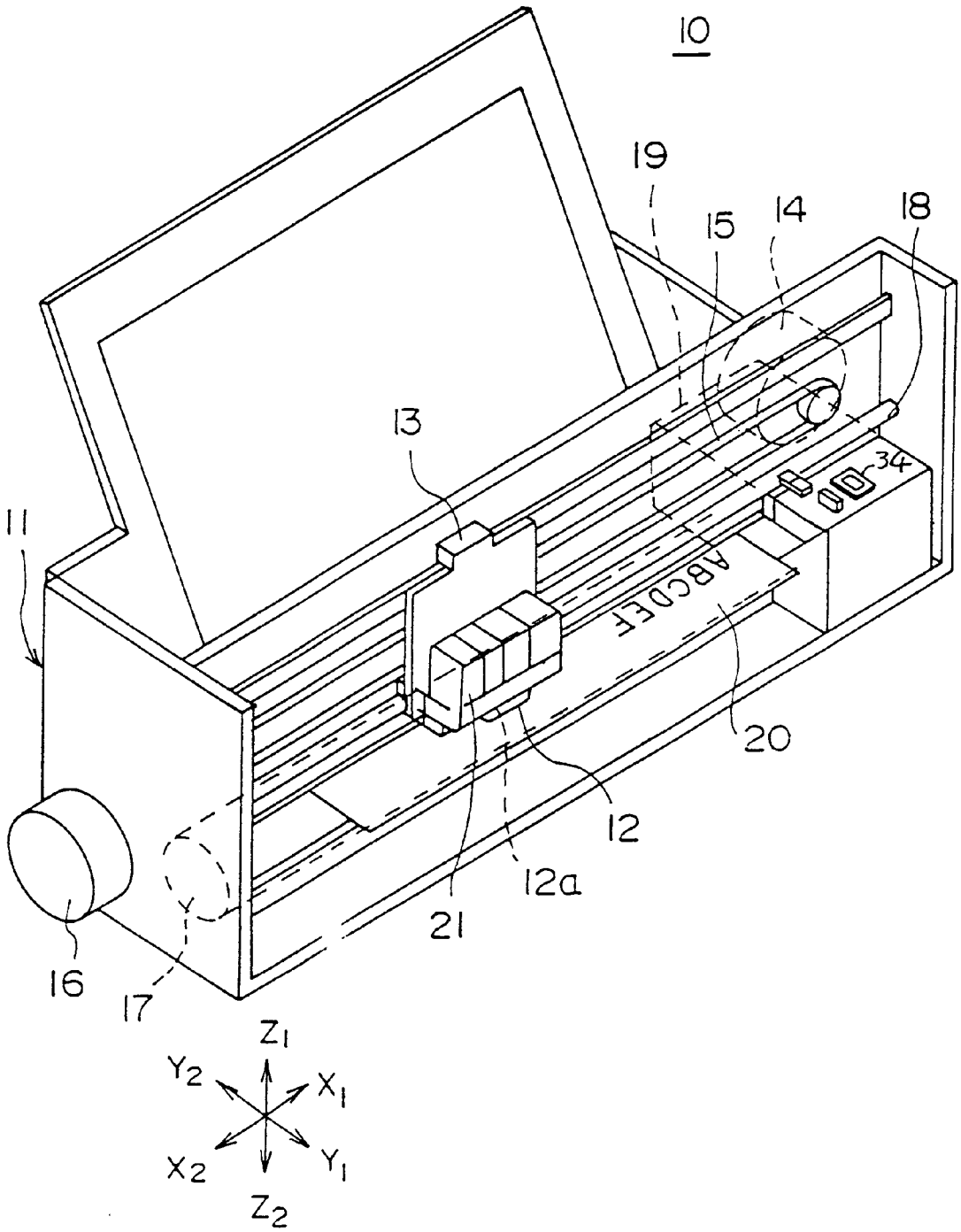
FIG. 1 shows a perspective view of an ink-jet printer in one embodiment of the present invention.

With reference to FIG. 1, an ink-jet printer 10 in an embodiment of the present invention will now be described.

In general, the ink-jet printer 10 includes a frame 11, an ink-jet head 12, a carriage 13, a space motor 14, a timing belt 15, a line feeding motor 16, a paper feeding roller 17, a guide stay 18 and an ink-jet head back-up device 19.

As shown in the figure, the ink-jet head back-up device 19 is placed at the end of the ink-jet printer 10 in the X1 direction.

The ink-jet head 12 is fixed to the carriage 13. Ink is sprayed downwardly in FIG.1 from the nozzles 12*a* of the ink-jet head toward a sheet of paper 20. A plurality of ink cartridges 21 are mounted on the top of the ink-jet head. The carriage 13 is driven by the space motor 14 through the timing belt 15, and moves in the X1 and X2 directions along the guide stay 18. Printing of characters and so forth to the sheet of paper 20 is performed during the movement of the ink-jet head 12 in the X1 and X2 directions. The sheet of paper 20 is fed in the Y1 direction by the line feeding motor 16 through a well-known sheet feeding mechanism (not shown in the figure) including the roller 17.

With reference to FIGS. 2, 3, 4A, 4B and 4C, the ink-jet head back-up device 19 will be described.

Figure 2:
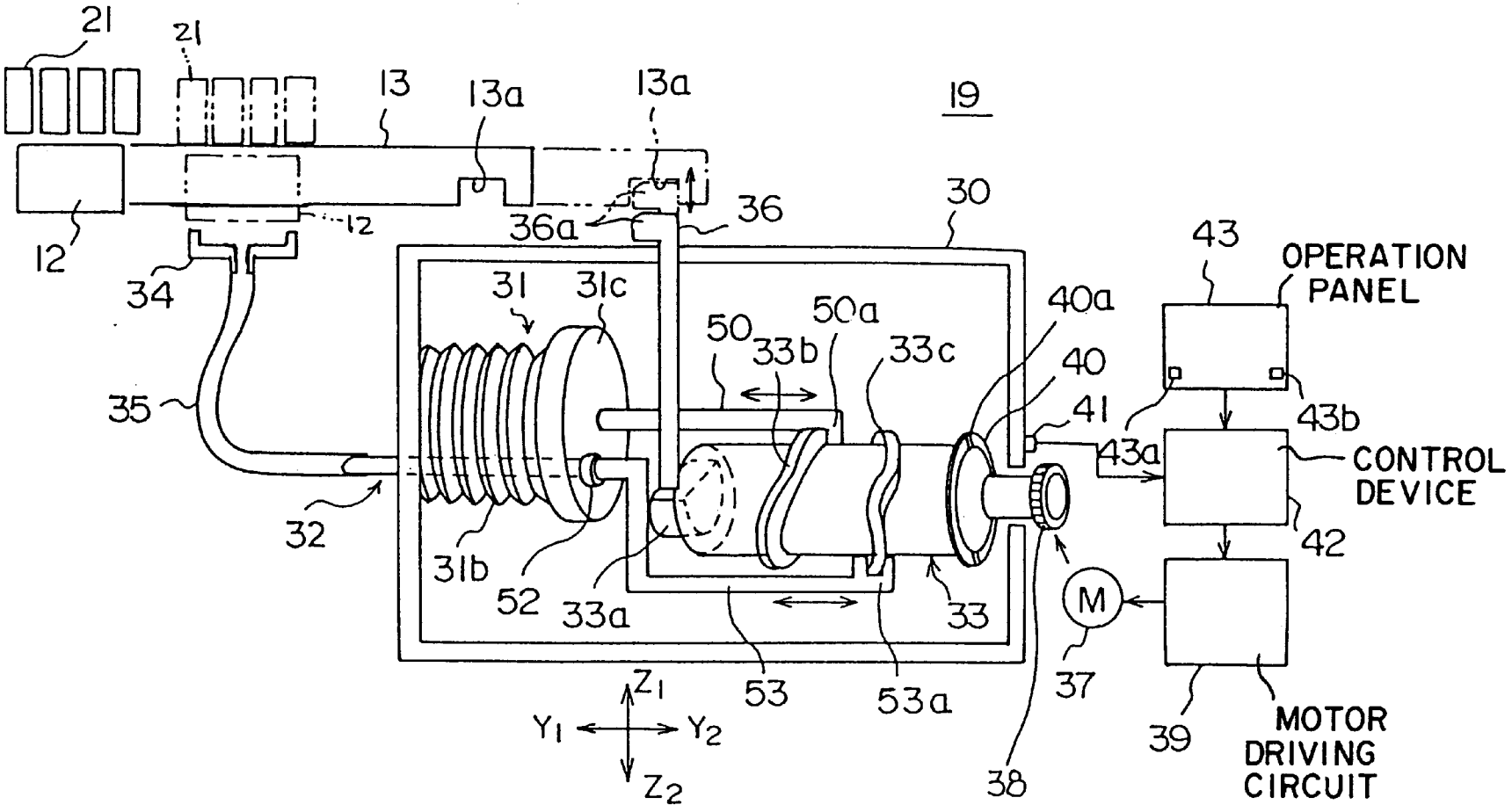
FIG. 2 shows an ink-jet head back-up device in the embodiment of the present invention.
Figure 3:
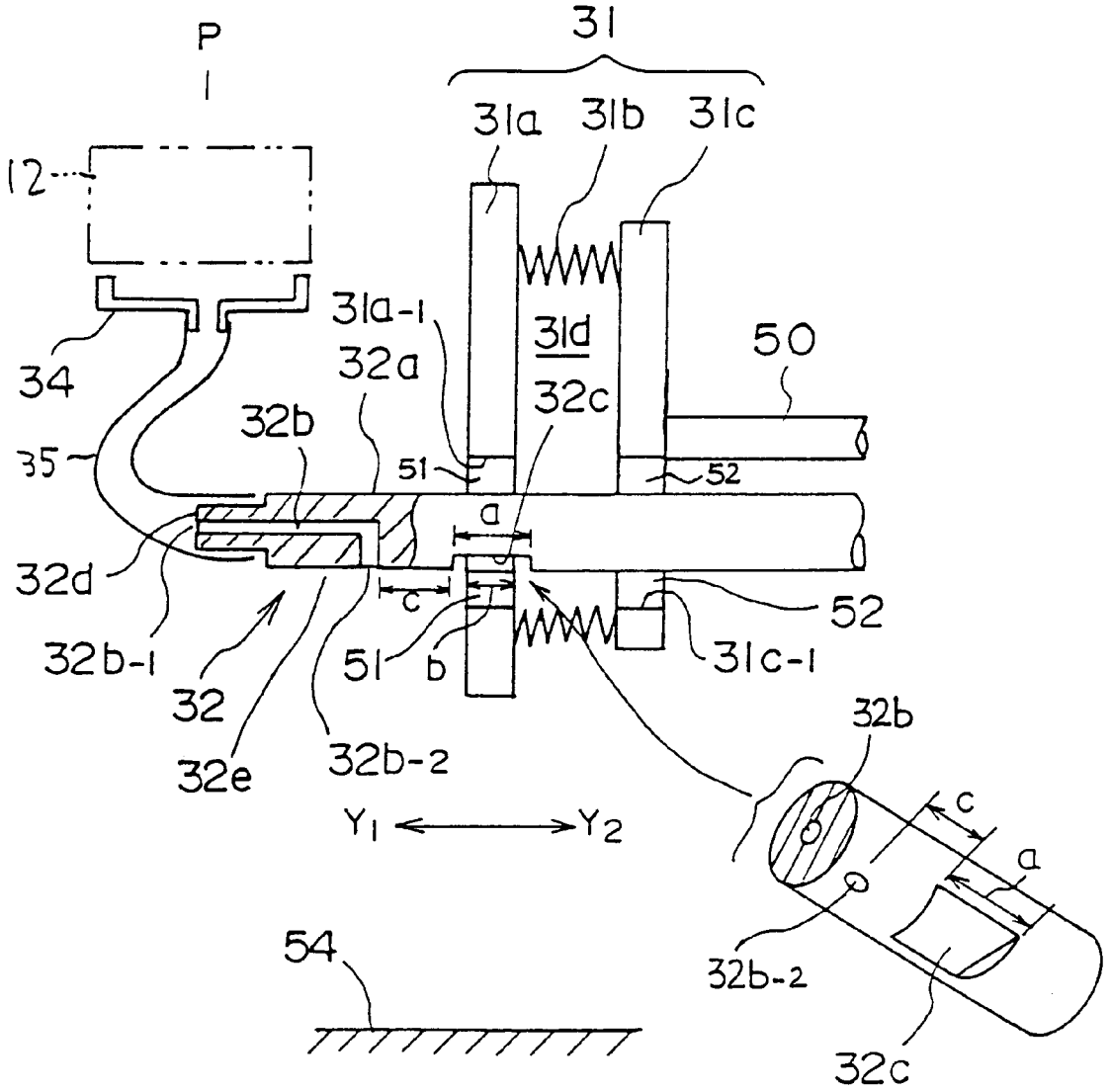
FIG. 3 shows a relationship between a bellows pump and a rod valve in a printing operation in the device shown in FIG. 2.
Figures 4A, 4B, 4C:
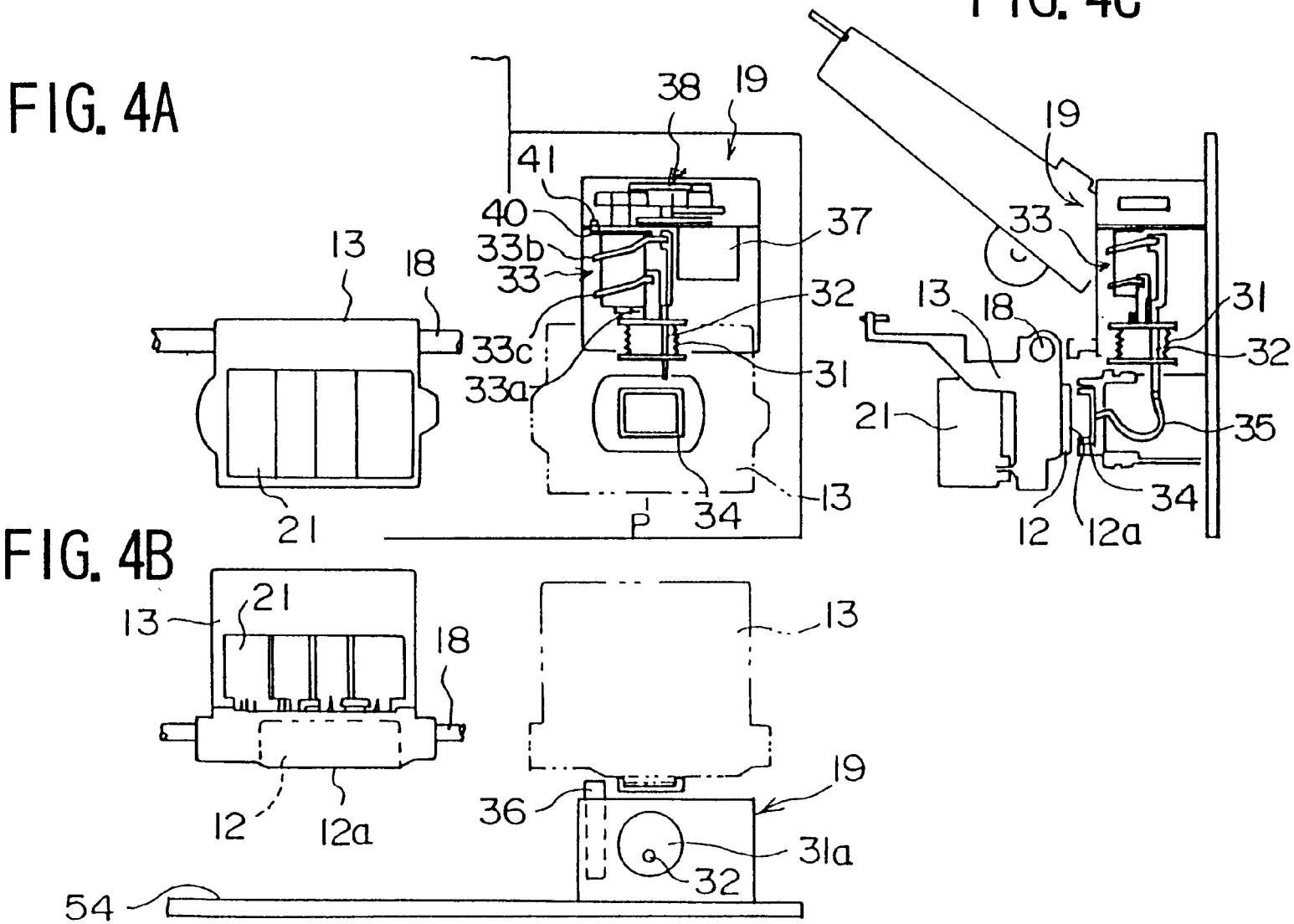
FIGS. 4A, 4B and 4C show a portion of the ink-jet head back-up device in the ink-jet printer shown in FIG. 1.

FIGS. 2, 3 shows operational state in which the ink-jet printer performs printing operations.

The ink-jet head back-up device 19 includes a housing 30, a bellows pump 31, a rod valve 32, a cam member 33, a nozzle cap 34, a tube 35, a carriage locking rod 36, a motor 37, a reduction gear 38, a motor driving circuit 39, a slit plate 40, a sensor 41, a control device 42 and an operation panel 43.

The cam member 33 has a cylindrical shape which extends in the Y1 and Y2 direction, and is rotatably supported in the housing 30. The slit plate 40 is provided on the cam member 33 at the Y2-direction end, and has a carriage locking rod driving cam 33*a* at the Y1-direction end. The cam member 33 has a bellows pump driving cam 33*b* and a rod valve driving cam 33*c* between the two ends of the cam member 33. Each of the bellows pump driving cam 33*b* and rod valve driving cam 33*c* is flange-shaped as shown in FIG. 2.

The reference position $Q_0$ (see FIG. 8D) of the cam member 33 is a position at which a predetermined slit 40*a* of the slit plate 40 is detected by the sensor 41 on the housing 30. The position is used as the reference position, and the cam member 33 is rotated until another slit of the slit plate 40 is detected by the sensor 41.

Figures 8A, 8B, 8C, 8D:
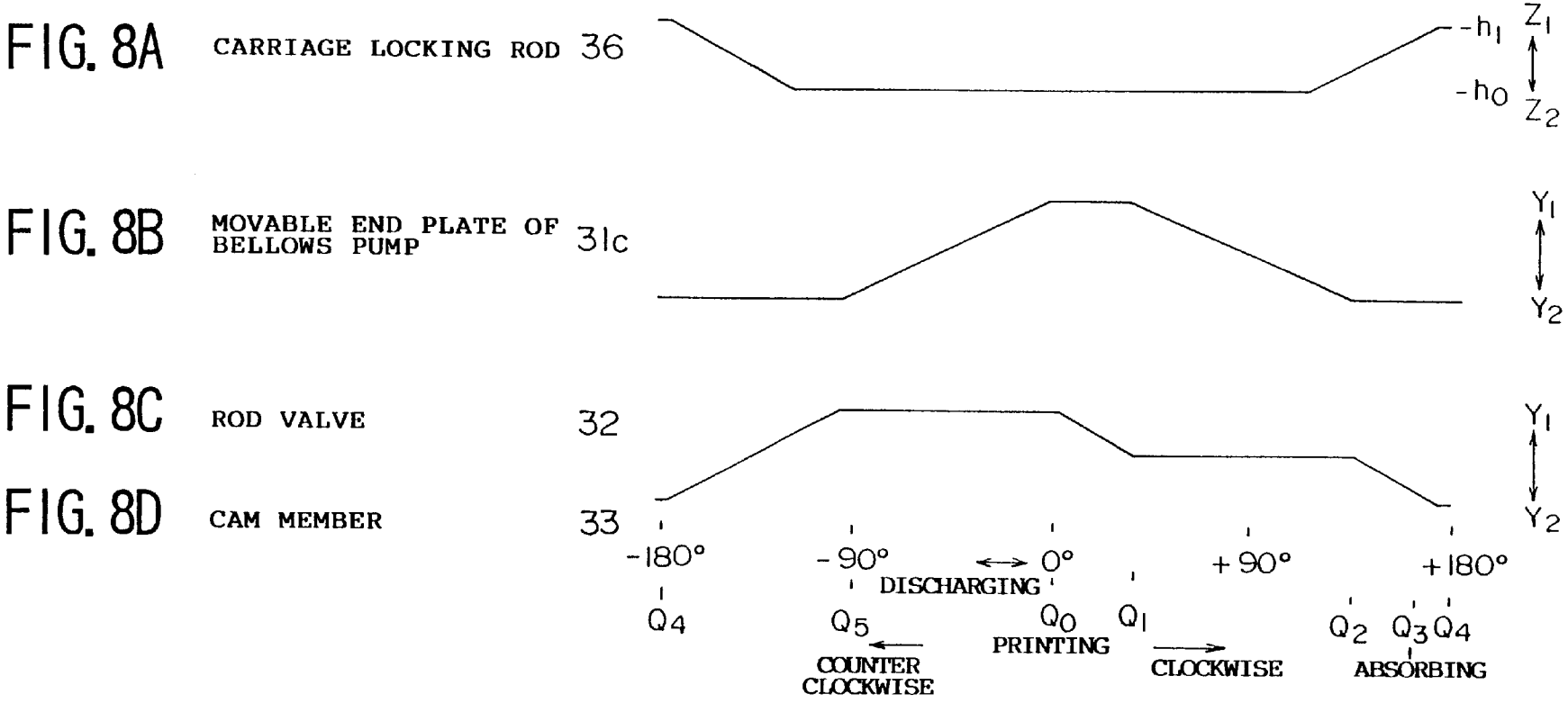
FIGS. 8A, 8B, 8C and 8D show the relationship between a rotation angle of a cam member and operations of a carriage locking rod, a movable end plate of the bellows pump and the rod valve.

The carriage locking rod driving cam 33*a* has a shape such that the carriage locking rod 36 is moved as shown in FIG. 8A. The bellows pump driving cam 33*b* has a shape such that the bellows pump 31 is moved as shown in FIG. 8B. The rod valve driving cam 33*c* has a shape such that the rod valve 32 is moved as shown in FIG. 8C.

The bellows pump 31 is provided inside the housing 30 and includes a fixed end plate 31*a*, a bellows 31*b* and a movable end plate 31*c*. The fixed end plate 31*a* is fixed to the end of the housing 30 in the Y1 direction. The bellows 31*b* expands and contracts, and the movable end plate 31*c* is movable in the Y1 and Y2 directions. In the bellows 31b, an internal space 31d is present as shown in FIG.3. A rod 50 extends in the Y2 direction from the movable end plate 31*c*. A F-shape yoke portion 50*a* is provided at the Y2-direction end of the rod 50. The yoke portion 50*a* sandwiches the cam 33*b*.

As shown in FIG. 3, holes or openings 31*a*-1 and 31*c*-1 are formed in the fixed end plate 31*a* and movable end plate 31*c*, respectively. The rod valve 32 passes through the holes 31*a*-1 and 31*c*-1. On the inner wall of each of the holes 31*a*-1 and 31*c*-1, a ring-shaped packing is provided.

As shown in FIG. 3, the rod valve 32 includes a body 32*a* of an approximately cylindrical shape. An ink absorbing intake path 32*b* and an ink discharging groove 32*c* are formed in the body 32*a*.

The ink absorbing intake path 32*b* is formed in the Y1-direction end portion of the body 32*a*. The ink absorbing intake path 32*b* extends inside the body 32*a* between an opening 32*b*-1 at the Y1-direction end surface 32*d* of the body 32*a* and an opening 32*b*-2 on the circumferential wall 32*e* of the body 32*a*.

The ink discharging groove 32*c* is formed as a result of partially cutting out the circumferential wall 32*e* of the body 32*a*. The length of the groove 32*c* in the Y1 and Y2 directions is 'a'. As shown in FIG. 3, the length 'a' of the groove 32*c* is longer than the thickness 'b' of the packing 51. The ink discharging groove 32*c* is positioned away from the above-mentioned opening 32*b*-2 in the Y2 direction by a distance 'c'. The ink discharging groove 32*c* faces a surface 54 on which the ink-jet head back-up device 19 is set.

The rod valve 32 passes through the hole 31*a*-1 of the fixed end plate 31*a* and the hole or opening 31*c*-1 of the movable end plate 31*c*, and thus passes through the bellows pump 31. Thus, the rod valve 32 passes through the internal space 32*d* of the bellows 32*b*. As shown in FIG. 3, the rod valve 32 extends horizontally. The rod valve 32 can slide in the Y1 and Y2 directions (the axis direction of the rod valve 32) with respect to the holes 31*a*-1 and 31*c*-1 (packings 51 and 52) of the fixed end plate 31*a* and the movable end plate 31*c*. As shown in FIG. 6B, when the ink discharging groove is not present in the holes 31*a*-1 and 31*c*-1, the positions at which the rod valve 32 passes through the fixed end plate 31*a* and the movable end plate 31*c* are maintained airtight by the packings 51 and 52.

As shown in FIG. 2, a rod 53 extends in the Y2 direction from the rod valve 32. An F-shape yoke portion 53*a* is provided at the end of the rod 53 which extends in the Y2 direction. The yoke portion 53*a* sandwiches the cam 33*c*.

The Y1-direction end of the rod valve 32 and the nozzle cap 34 are connected together by the flexible tube 35.

The carriage locking rod 36 has a locking portion 36*a* at the top end thereof. In a condition where the locking portion 36*a* projects upward from the housing 30 and the bottom end of the carriage locking rod 36 is in contact with the cam 33*a*, the carriage locking rod 36 is supported so as to be movable in the Z1 and Z2 directions.

Operations of the above-described ink-jet head back-up device 19 will now be described.

As shown in FIG. 2, in the ink-jet head back-up device 19, the control device 42 operates the motor driving circuit 39 and the motor 37 is driven. The motor 37 rotates the cam member 33 via the reduction gear 38. Thereby, the bellows pump 31 and rod valve 32 are independently driven and operate. Thus, a purge operation is performed. The control device 42 operates according to a signal from the operation panel 43 and a signal from the sensor 4.

A reference state of the ink-jet head back-up device 19 is the printing operation state.

FIGS. 8A, 8B, 8C and 8D show relationships between rotation positions of the cam member 33 and operations of the carriage locking rod 36, movable end plate 31*c* and rod valve 32.

FIG. 1 shows the state in which the ink-jet printer 10 performs a printing operation. At this time, the ink-jet head back-up device 19 is in the state shown in FIGS. 2 and 3. The cam member 33 is at the reference position $Q_0$.

Figure 5A:
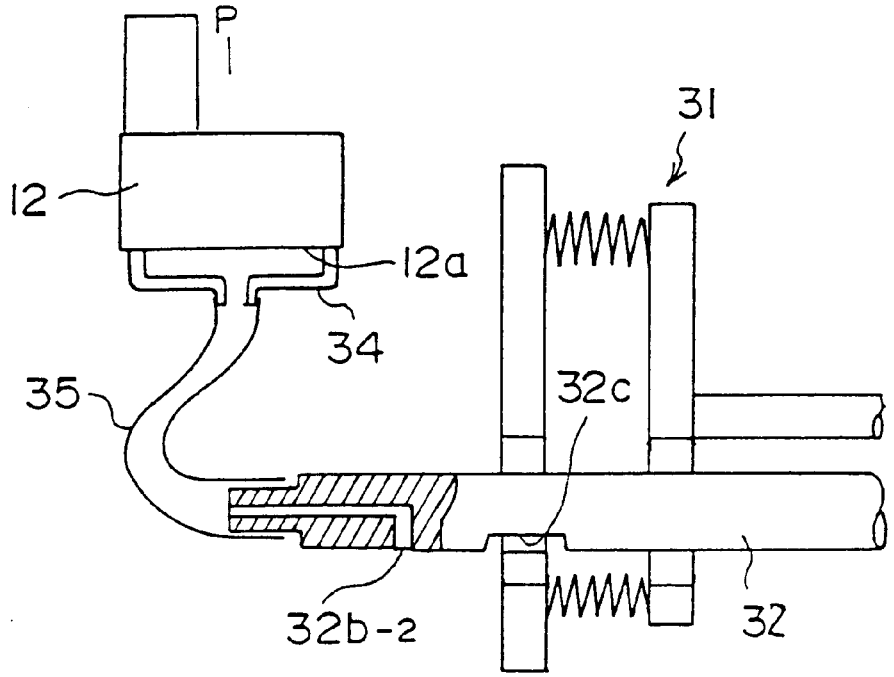
FIGS. 5A and 5B illustrate operations of covering an ink-jet head with a nozzle cap.

When the printing operation has been finished, and the ink-jet head 12 (carriage 13) has moved in the X1 direction and reached a standby position P (shown in FIG. 3), as shown in FIG. 5A, the nozzle cap moves upward and covers the nozzles 12*a* of the ink-jet head 12. At this time, the opening 32*b*-2 of the rod valve 32 is open to the atmosphere, and the operation of the nozzle cap 34 covering the nozzles 12*a* is performed without being disturbed or disrupted by in any way air in the tube 35.

When a power switch 43*a* (of the operation panel 43 shown in FIG. 2) of the ink-jet printer 10 is turned off, the motor 37 is driven, the cam member 33 is rotated clockwise to the position $Q_1$ shown in FIG. 8D, and is stopped at the position $Q_1$. Thereby, the ink-jet head back-up device 19 assumes the state shown in FIG. 5B. That is, the rod valve 32 is slightly moved in the Y2 direction and the opening 32*b*-2 of the rod valve 32 is shut by the packing 51. Thereby, ink in the nozzles 12*a* is prevented from becoming dry.

Replacement of an empty ink cartridge 21 with a new ink cartridge will now be described.

Ink cartridge replacement is performed in a condition where the ink-jet head 12 (carriage 13) is positioned at the standby position P and the power switch 43*a* (shown in FIG. 2) has been turned on. Then, after the replacement has been finished, a replacement completion switch 43*b* of the operation panel 43 (shown in FIG.2) is pressed.

Thereby, as described below, first, a main purge is performed, and then, an emptying purge is performed.

The main purge is performed as described below.

When the ink cartridge 21 is replaced (see FIG. 6A) and the replacement completion switch 43*b* is pressed, the motor 37 is driven and the cam member 33 rotates one revolution in the clockwise direction.

Figure 5B:
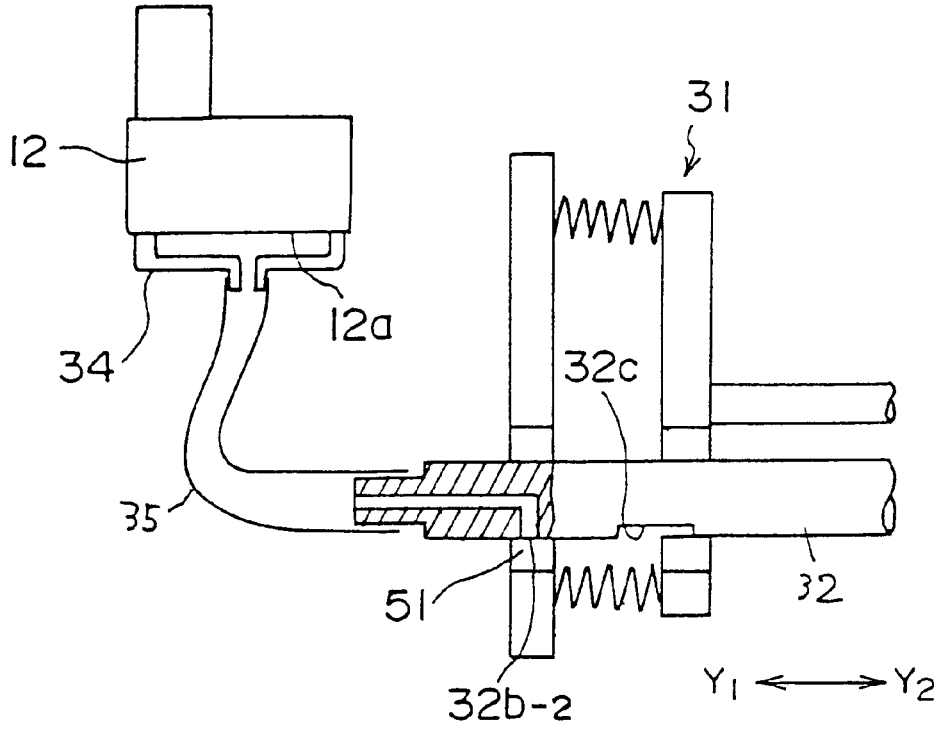
Figure 6A:
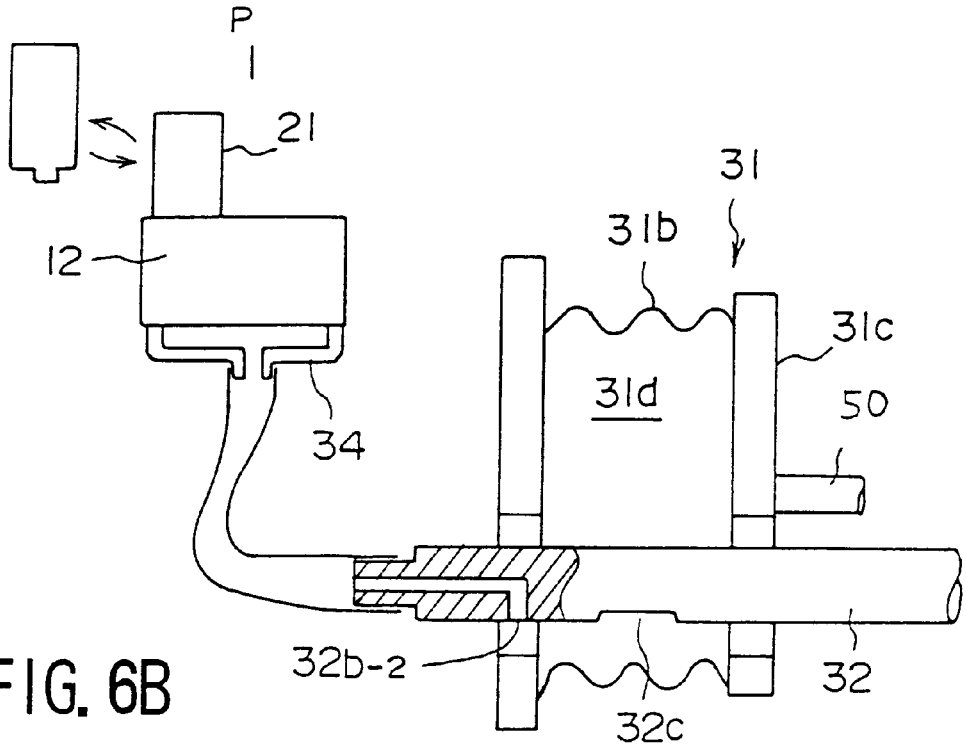
FIGS. 6A and 6B illustrate absorbing of ink.
Figure 6B:
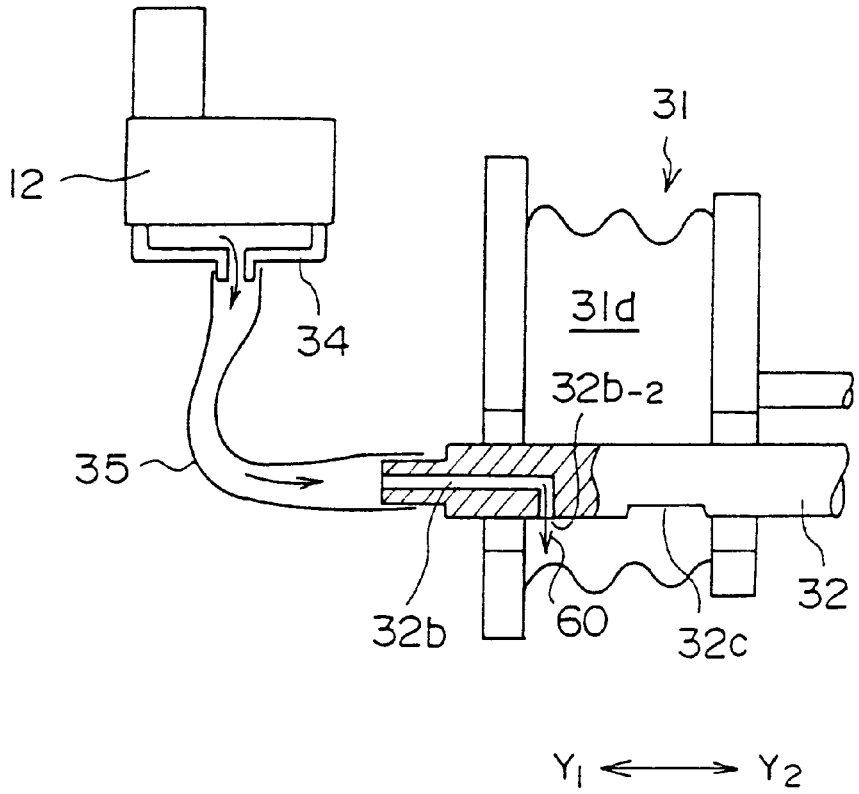

Although the cam member 33 rotates clockwise from the position $Q_1$ as shown in FIG. 6A, the rod valve 32 does not move from the position shown in FIG. 5B.

When the cam member 33 starts clockwise rotation from the position $Q_1$, as shown in FIG. 6A, the movable end plate 31*c* is moved in the Y2 direction by the bellows pump driving cam 33*b*. As a result, the bellows 31*b* of the bellows pump 31 expands and the volume of the internal space 31*d* increases. At this time, the opening 32*b*-2 is not exposed to the internal space 31*d*. Accordingly, when the volume of the internal space 31*d* increases, a negative pressure condition occurs.

When the cam member 33 has rotated clockwise and has passed through the position $Q_2$, the rod valve 32 starts moving in the Y2 direction. Then, when the cam member 33 has reached the position $Q_3$, as shown in FIG. 6B, the opening 32*b*-2 is exposed to the internal space 31d which is in the negative pressure condition. Thus, the nozzle cap 34 communicates with the internal space 31d (this state is a first state). When the opening 32*b*-2 is exposed to the internal space 31*d* which is in the negative pressure condition, ink and bubbles in the nozzles 12*a* of the ink-jet head 12 are absorbed. The absorbed ink and bubbles pass through the tube 35 and the ink absorbing path 32*b*, and, as indicated by an arrow 60, are absorbed or received in the bellows pump 31.

When the cam member 33 further rotates after the ink and bubbles have been absorbed or received in the bellows pump 31, the bellows pump 31 and the rod valve 32 operates as described below.

Figure 7A:
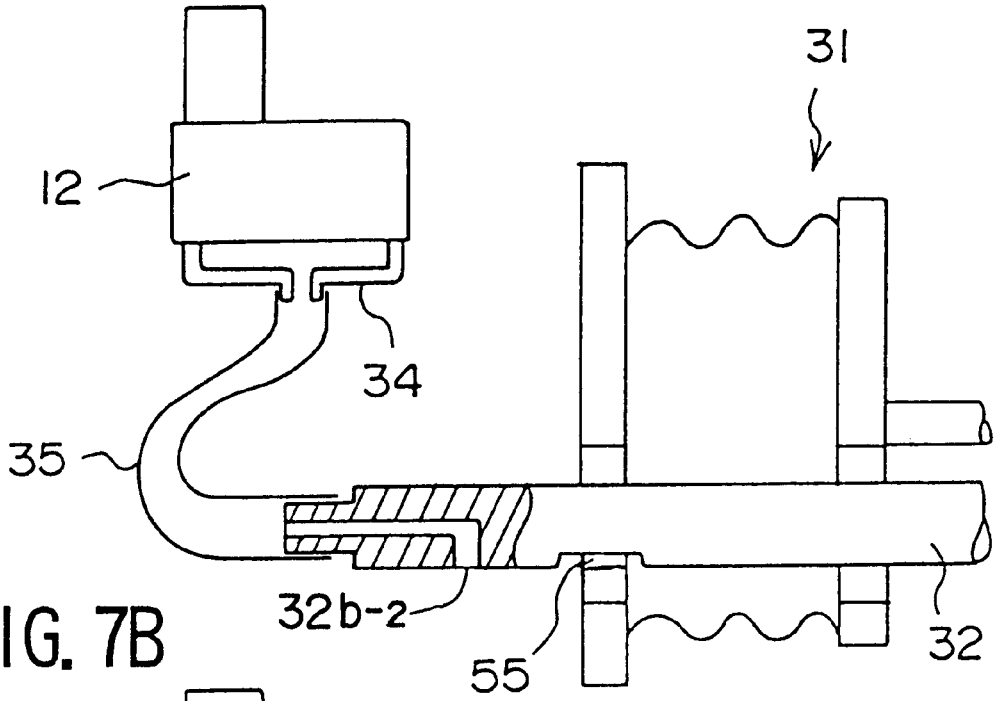
FIGS. 7A and 7B illustrate discharging of ink.

During the rotation of the cam member 33 through the sequence $Q_3 \rightarrow Q_4 \rightarrow Q_5$, the condition where the movable end plate 31*c* has been stopped is maintained and the bellows pump 31 is maintained in the condition where the bellows 31*b* has expanded as shown in FIG. 7A.

When the cam member 33 has passes through the position $Q_4$, the rod valve 32 is driven by the rod valve driving cam 33*c*, and the rod valve 32 starts moving in the Y1 direction. Thus, the rod valve 32 projects from the fixed end plate 31*a*. The opening 32*b*-2 moves out from the bellows pump 31. When the cam member 33 has reached the position $Q_5$, the rod valve 32 is in the state shown in FIG. 7A. Thus, the opening 32*b*-2 has moved out from the bellows pump 31, and the internal space 31*d* does not communicate with the nozzle cap 34 (this state is a second state). Further, the ink discharging groove 32*c* is aligned with the packing 51, and extends across the packing 51. Thereby, the ink discharging groove 32*c* forms a discharge path 55 which passes through the fixed end plate 31*a*. Accordingly, the internal space 31d communicates with the external space (this state is a third state).

Figure 7B:
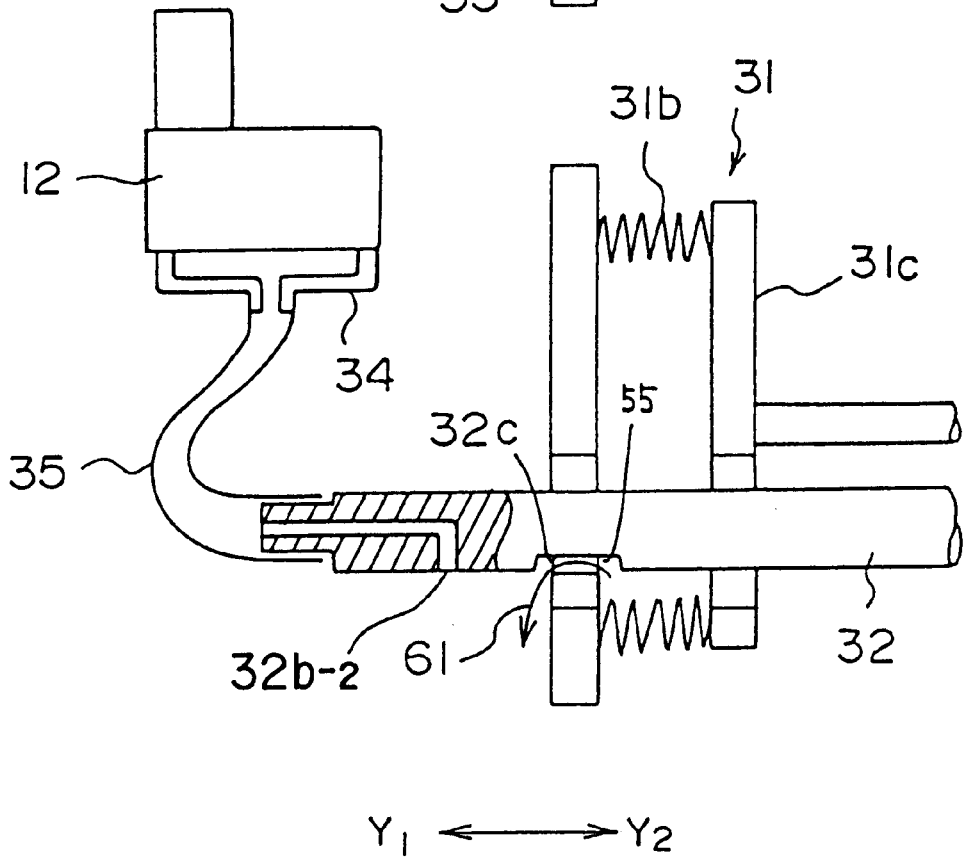

During the rotation of the cam member 33 through the sequence $Q_5 \rightarrow Q_0$, the rod valve 32 does not move, as shown in FIG. 7B.

During this time, as shown in FIG. 7B, the movable end plate 31*c* is driven by the bellows pump driving cam 33*b* and is moved in the Y1 direction. Accordingly, the bellows 31*b* of the bellows pump 31 is compressed and the volume of the internal space 31*d* is reduced. Thereby, the ink which was absorbed or received in the bellows pump 31 is discharged outside of the bellows pump 31 (the housing 30), through the discharge path 55 as indicated by an arrow 61. Although the reduced volume of the internal space 31*d* is not zero in FIG. 7B, the volume of the internal space 31*d* is reduced to approximately zero at this time.

The thus-discharged ink is absorbed by an absorbing member (not shown in the figures) which is provided outside of the housing 30.

Thus, the main purge is finished.

As seen from the above description, the opening 32*b*-2 moves out from the interior of the bellows pump 31 before the bellows pump 31 is compressed. Accordingly, the ink which was absorbed or received in the bellows pump 31 does not flow backward to the nozzle cap 34. As a result, ink absorbed or removed from the nozzles 12*a* is prevented from adhering to the nozzles 12*a*.

Further, the discharge path 55 is formed at the bottom of the rod valve 32. In comparison to a case where such a discharge path is formed at the top of the rod valve 32, the amount of ink which can be discharged from the bellows pump 31 is increased when the discharge path 55 is formed at the bottom of the rod valve 32. Thus, a smooth discharge of ink from the bellows pump 31 can be achieved.

Further, during the rotation of the cam member 33 through the sequence $Q_2 \rightarrow Q_4$, the carriage locking rod 36 is pushed up by the carriage locking rod driving cam 33*a*, as shown in FIG. 8A. Thereby, as shown in FIG. 2, the locking portion 36*a* of the carriage locking rod 36 is inserted into a recess 13*a* of the carriage 13. Thus, the carriage locking rod 36 locks the carriage 13 at the standby position P. Accordingly, during the absorption of ink from the nozzles 12*a* into the bellows pump 31, the carriage 13 is locked and does not move. Thereby, the carriage 13 is prevented from accidental movement when ink is absorbed from the nozzles 12*a* into the bellows pump 31. The prevention of accidental movement prevents the nozzle cap 34 being removed from the ink-jet head 12. Accordingly, accidental discharge of ink is positively prevented. If the nozzle cap 34 is removed from the ink-jet head 12, ink can be uncontrollably discharged and surrounding portions are soiled or contaminated by the accidentally discharged ink.

The emptying purge is performed after the carriage 13 is moved in the X2 direction in FIG. 1 and the nozzle cap 34 is removed from the ink-jet head 12. In this condition, the cam member 33 is rotated one revolution in the clockwise direction, and the ink-jet head back-up device 19 operates similar to the case of the main purge. Thereby, ink remaining inside the tube 35 and the nozzle cap 34 is absorbed or received in the bellows pump 31. Thus, cleaning of the tube 35 and the nozzle cap 34 is performed.

Further, as it is seen from a comparison of FIGS.8B and 8C, the bellows pump driving cam 33*b* and the rod valve driving cam 33*c* are configured so that the cam 33*c* does not move the rod valve 32 when the cam 33*b* moves the bellows pump 31 (movable end plate 31c), and the cam 33*b* does not move the bellows pump 31 when the cam 33*c* moves the rod valve 32. Thus, the load borne by the motor 37 is dispersed. Accordingly, a low-torque motor can be used as the motor 37 and the back-up device 19 operates smoothly.

Further, the above-described main purge and emptying purge may be performed periodically independent of ink cartridge replacement.

Further, as it is seen from the above descriptions, the cam member 33 includes the carriage locking rod driving cam 33*a*, the bellows pump driving cam 33*b* and the rod valve driving cam 33*c*. Accordingly, only one motor 37 drives the carriage locking rod, the bellows pump and the rod valve. As a result, it is possible to miniaturize the back-up device 19.

Further, the bellows pump can be replaced with another and different type pump.

The present invention is not limited to the above-described embodiments, and variations and modifications may be made without departing from the scope of the present invention claimed in the following claims.

What is claimed is:

1. An ink-jet head back-up device, comprising:

a pump which absorbs ink from nozzles of an ink-jet head by increasing an internal space thereof and discharges the ink by decreasing said internal space;

a valve which has an absorbing path formed therein and a discharge groove formed thereon, and passes through an wall of said pump;

a communicating unit which communicates with a first end of said absorbing path of said valve so as to connect said nozzles of said ink-jet head to said internal space of said pump through said absorbing path, wherein:

when said pump absorbs ink from said nozzles of said ink-jet head, said valve moves through said wall of said pump so that a second end of said absorbing path is exposed to said internal space of said pump, and said internal space of said pump is increased, and when said pump discharges ink, said valve moves through said wall of said pump so that said second end of said absorbing path is opened externally and said discharging groove is aligned with said wall of said pump, and said internal space of said pump is decreased.

2. An ink-jet head back-up device for absorbing one of ink and bubbles from nozzles of an ink-jet head which performs printing by spraying ink, said device comprising:

a nozzle cap which covers said nozzles of said ink-jet head;

a pump having an internal space which increases and decreases in volume;

a rod valve which is connected with said nozzle cap through a tube, has a rod shape, is provided so as to enter and exit from said internal space of said pump, and, depending on its position, is in a first state in which said nozzle cap communicates with said internal space of said pump, is in a second state in which said nozzle cap is prevented from communication with said internal space of said pump, and is in a third state in which said internal space of said pump communicates with an external space;

pump driving means for driving said pump;

rod valve driving means for moving said rod valve in an axis direction; and control means for controlling said pump driving means and said rod valve driving means so that, after said volume of said internal space of said pump is increased and said rod valve is in said first state so that ink is absorbed from said nozzles of said ink-jet head into said internal space of said pump, said rod valve is in said second state, then said volume of said internal space of said pump is decreased and said rod valve is in said third state.

3. The ink-jet head back-up device, according to claim 2, wherein said rod valve is arranged so as to have a horizontal axis, and a groove for forming said third state is provided at a lower portion of said rod valve.

4. The ink-jet head back-up device according to claim 2, wherein said pump driving means, said rod valve driving means and said control means comprise:

a cam member which has a pump driving cam having a predetermined shape and a rod valve driving cam having a predetermined shape; and a motor which rotates said cam member.

5. The ink-jet head back-up device according to claim 4, wherein said pump driving cam and said rod valve driving cam are formed so that said rod valve driving cam is inoperable for moving said rod valve when said pump driving cam drives said pump, and said pump driving cam is inoperable for driving said pump when said rod valve driving cam moves said rod valve.

6. The ink-jet head back-up device according to claim 4, wherein:

said cam member further has a carriage locking rod driving cam; and a carriage locking rod is moved by said carriage locking rod driving cam so that said ink-jet head is locked when ink is absorbed in said internal space of said pump from said nozzles of said ink-jet head.

7. An ink-jet printer comprising:

an ink-jet head which sprays ink so as to perform printing; and an ink-jet head back-up device for absorbing one of ink and bubbles from nozzles of said ink-jet head, said ink-jet head back-up device comprising:

a nozzle cap which covers said nozzles of said ink-jet head;

a pump having an internal space which increases and decreases in volume;

a rod valve which is connected with said nozzle cap through a tube, has a rod shape, is provided so as to enter and exit from said internal space of said pump, and, depending on its position, is in a first state in which said nozzle cap communicates with said internal space of said pump, is in a second state in which said nozzle cap is prevented from communicating with said internal space of said pump, and is in a third state in which said internal space of said pump communicates with an external space;

pump driving means for driving said pump;

rod valve driving means for moving said rod valve in an axis direction; and control means for controlling said pump driving means and said rod valve driving means so that, after said volume of said internal space of said pump is increased and said rod valve is in said first state so that ink is absorbed from said nozzles of said ink-jet head into said internal space of said pump, said rod valve is in said second state, then said volume of said internal space of said pump is decreased and said rod valve is in said third state.

* * * * *